US008381516B2

(12) United States Patent
Grossart

(10) Patent No.: US 8,381,516 B2
(45) Date of Patent: Feb. 26, 2013

(54) APPARATUS AND METHODS FOR ACTUATION

(75) Inventor: Stuart Grossart, Britghton (GB)

(73) Assignee: L-3 Communications Link Simulation and Training UK Limited, London (GB)

( * ) Notice: Subject to any disclaimer, the term of this patent is extended or adjusted under 35 U.S.C. 154(b) by 499 days.

(21) Appl. No.: 10/583,032

(22) PCT Filed: Dec. 16, 2004

(86) PCT No.: PCT/EP2004/053526

§ 371 (c)(1),
(2), (4) Date: Apr. 27, 2007

(87) PCT Pub. No.: WO2005/059372

PCT Pub. Date: Jun. 30, 2005

(65) Prior Publication Data

US 2007/0199315 A1 Aug. 30, 2007

(30) Foreign Application Priority Data

Dec. 17, 2003 (GB) ..... 0329243.0

(51) Int. Cl.
*F16D 31/02* (2006.01)

(52) U.S. Cl. ..... 60/476

(58) Field of Classification Search ..... 60/476, 60/475

See application file for complete search history.

(56) References Cited

U.S. PATENT DOCUMENTS

| | | | | |
|---|---|---|---|---|
| 4,375,181 | A | 3/1983 | Conway | |
| 4,928,487 | A * | 5/1990 | Nikolaus | 60/414 |
| 5,220,862 | A | 6/1993 | Schexnayder | |
| 5,237,916 | A | 8/1993 | Malashenko | |
| 6,520,731 | B2 * | 2/2003 | MacLeod | 60/476 |
| 2003/0097837 | A1 * | 5/2003 | Hiraki et al. | 60/486 |

FOREIGN PATENT DOCUMENTS

| | | |
|---|---|---|
| DE | 14 06 784 | 4/1969 |
| JP | 11 117907 | 4/1999 |

* cited by examiner

*Primary Examiner* — F. Daniel Lopez

(74) *Attorney, Agent, or Firm* — Lowe Hauptman Ham & Berner, LLP

(57) ABSTRACT

There is disclosed an actuator (5) having an actuator chamber (6) and actuator piston (9) therein defining an extend chamber (10) and a retract chamber (7) separated from the extend chamber by the actuator piston.

A first fluid pump (A) is in fluid communication with the extend chamber and the retract chamber and is arranged to transfer therebetween volumes of fluid substantially equal in magnitude to changes in the volume of the retract chamber resulting from movement of the actuator piston within the actuator chamber. A second pump B connected to the extend chamber and to an accumulator (17) allows the differential volume between the extend and retract chambers to be displaced into the accumulator at a pressure. Stored accumulator fluid pressure enables pump B to be back-driven so that it behaves as a motor whenever the pressure in conduit 15 is less than in conduit 16. A pre-charge (20) unit pressurizes the system until full mass counterbalance of the suspended load is achieved. In this state little or no input power from the servo motor (via pumps A & B) will be needed and significant energy savings can be made.

28 Claims, 4 Drawing Sheets

APPARATUS AND METHODS FOR ACTUATION

The present invention relates to apparatus and methods of actuation, particularly, though not exclusively, to actuation and actuators for use in providing simulated motion in a vehicle simulator machine.

Motion systems commonly used for providing simulated motion in a vehicle simulator machine comprise a group of hydraulic actuators arranged together to support a vehicle simulator platform and operable to provide six degrees of freedom of movement of that platform. An example of a motion system providing six degrees of freedom of motion for an aircraft simulator platform is illustrated in FIG. 1. The motion system 1 comprises a group of six linear actuators 2 each separately operable and each coupled to a motion platform 3 by an articulated joint 4 which permits movement of the joint 4, and the motion platform 3 connected to it, in any of six degrees of freedom in response to the linear extension/retraction of any number of the six hydraulic actuators 2.

In motion systems using hydraulic actuators, such as illustrated in FIG. 1 for example, each hydraulic actuator is typically controlled by a servo valve which regulates the transfer of pressurised fluid into an out of the hydraulic chambers of the hydraulic actuators. In use, hydraulic fluid is continuously pumped to the hydraulic chambers of each actuator of the motion system, via the servo valve(s), at the maximum pressure available to the motion system, irrespective of the force output the actuators are intended to supply. This makes very inefficient use of the energy supplied to the motion system as a whole. Moreover, such hydraulic motion systems typically require a remote Hydraulic Power Unit (HPU) which is not only noisy but also requires a dedicated cooling system (much heat being generated due to the loss of input energy associated with this type of system.

Because of the heat and noise generated by HPUs, and the space required for their associated cooling units, HPUs are typically located in a room separate from the motion system they serve. A consequence of this remote location is the need for long hydraulic fluid conduits which place the HPU in fluid communication with the actuators of the motion system in question. In addition, large capacity pressurised oil accumulators are mounted close to each actuator to meet peak flow demand. The provision of such conduits is expensive and highly inflexible and inconvenient. Large volumes of hydraulic fluid must be employed in order to fill the relatively large combined volume of the HPU fluid chamber(s), the chambers of the hydraulic actuators served by the HPU, and the conduits connecting the former to the latter. This is undesirable.

Motion systems employing electric actuators typically require actuators which are large, heavy, complex and expensive. Such actuators are very difficult, if not effectively impossible, to service when in situ within a motion system.

The present invention aims to overcome at least some of the aforementioned deficiencies in the prior art.

As is well known in the art, a hydraulic actuator may have an actuator chamber containing a moveable actuator piston and an actuator rod connected to the actuator piston and retractably extendable from the actuator chamber.

In a "double-acting" chamber, the actuator chamber and actuator piston define an extend chamber and a retract chamber separated from the extend chamber by the actuator piston. In a "differential" actuator, the actuator rod extends through the retract chamber only, and not through the extend chamber. The actuator is powered to extend its actuator rod by transferring fluid into the extend chamber and out of the retract chamber to cause the actuator piston to move to increase the volume of the extend chamber and thereby decrease that of the retract chamber. Retraction of the actuator rod is powered by a reverse movement of fluid.

At its most general, the present invention proposes supplying fluid to both the extend and retract chambers of a double-acting differential actuators to maintain the pressurised fluid in both the chambers at substantially the same pressure. The mutual pressure is most preferably chosen to be sufficient to enable the actuator to support its load. Extension or retraction of the actuator rod may then be achieved simply by moving the pressurised fluid into/out-of the extend/retract chambers, or the retract/extend chambers, respectively.

Consequently, the fluid pressure of the supplied fluid need only be sufficient to support the actuator load and no more. Furthermore, by supplying fluid at substantially the same pressure to both the extend and retract chambers of the actuator, one may simply reversibly transfer fluid from either one of those chambers to the other of those chambers as the volume of one chamber contracts while the other expands during movement of the actuator rod (and piston). Since little or no pressure differential will exist as between the mutually pressurised extend and retract chambers of the actuator, this fluid transfer may be done with relatively little effort. This is an energy efficiency.

The fluid transfer in each or either case may be affected by means other than the operation of valves to control the transfer of high-pressure fluid. Most preferably, separate reversible hydraulic pumps are used for such fluid transfer demanding lower energy inputs than are required in existing prior art systems.

In this way, the need for a remote HPU is obviated. By using fluid transfer means (e.g. hydraulic pumps) other than valves metering high-pressure fluid, one may avoid the heat and noise generated, and amount of energy consumed, in generating high-pressure hydraulic fluid otherwise required for serving the hydraulic actuators of a motion system (or any other system). The supply of hydraulic fluid to the actuators of the motion system may therefore be local rather than remote since the reasons for, and consequences of, remote fluid provision (as in a HPU) are no longer present.

Accordingly, in a first of its aspects, the present invention may provide an actuator having:

- an actuator chamber containing a moveable actuator piston and an actuator rod connected to the actuator piston and retractably extendable from the actuator;
- the actuator chamber and actuator piston defining an extend chamber and a retract chamber separated from the extend chamber by the actuator piston such that the actuator rod extends through the retract chamber;
- a fluid supply means arranged to supply fluid simultaneously to both the extend and retract chamber at substantially the same pressure and to reversibly transfer said pressurised fluid between the extend and retract chambers of the actuator.

Preferably, the pressure of the pressurised fluid simultaneously supplied to extend and retract chambers is determined according to the load being experienced by the actuator. The pressure of the pressurised fluid simultaneously supplied to extend and retract chambers is preferably determined according to the position/extension of the actuator rod of the actuator. Most preferably, the pressure is controlled to maintain equilibrium between the actuator and its load.

Most preferably, where pressurised fluid is supplied via a hydraulic accumulator, the supplied fluid pressure is varied/controlled by varying/controlling the fluid pressure and/or volume within the accumulator. Additional means for pressure variation/control may be employed (e.g. fluid pumps, fluid flow control valves etc).

The fluid supply means may include a first fluid transfer means for reversibly transferring the pressurised fluid between the extend and retract chambers, and a second fluid transfer means for generating pressure in the fluid separately from the actuator chamber and first fluid transfer means and for reversibly transferring pressurised fluid to the actuator chamber.

Most preferably, the second fluid transfer means includes a pressurising fluid store for storing fluid for supply to the actuator chamber and for controllably generating a fluid pressure therein. For example, the pressurising fluid store may be a fluid reservoir in fluid communication with a fluid pump for pumping fluid from the fluid reservoir to the actuator chamber in a pressurised state. Alternatively, or additionally, a suitable hydraulic accumulator may be employed, e.g. being of a type readily apparent to the skilled person.

In this way, the fluid supply means may comprise two parts: a first which is concerned with the transfer of fluid between the extend and retract chambers of the actuator and which, therefore, is a means via which the position of the actuator rod (i.e. extent of retraction/extension) and/or the rate/speed of changes in its position may be controlled; a second part which is concerned with the supply of pressurised fluid to the actuator chamber and is a means via which one may control the force with which the actuator resists a load in use, since it is the value of the pressure in the pressurised fluid supplied to the actuator chamber which determines this force. This force/pressure controllability enables the actuator to provide an effective variable mass counterbalance system to variably counterbalance changing load values in use.

The two parts of the actuator may be controlled separately and independently, or in tandem, in use to provide the desired effect in the actuator. The first and second parts may be physically separate, being in fluid communication via the actuator chamber only, or may most preferably be integrated by sharing fluid conduit parts for example.

The present invention preferably provides a control system for controlling the operation of the actuator, either alone or in combination with a plurality of such actuators acting in concert in a motion simulator platform or the like. The control system most preferably controls the actuator(s) by suitably controlling the transfer of fluid to and from the extend and retract chambers of the actuator chamber to control the extension/retraction position and/or speed of the actuator rod while also controlling the pressure of the fluid supplied to the actuator chamber so as to control the force exerted by the actuator rod.

In use, especially in a motion simulator platform, the (each) actuator will typically be subjected to different load pressures over a given period of time as the position/orientation of the load is changed over that period of time. This means that the actuator will be required to exert a correspondingly varying degree of mass counterbalance pressure in response to the changing load force. Preferably, the control system includes load monitoring means for monitoring the load force to which the actuator is subjected by the load applied to the actuator in use, and for controlling the fluid supply means (e.g. the second fluid transfer means and pressurising fluid store) to vary the pressure generated thereby in the pressurised fluid supplied to the actuator chamber in response to variations in the load force.

Where a plurality of actuators are employed in, for example, a vehicle simulator platform, each actuator will tend to be subject to load pressure variations differing from those of the other actuators of the platform, and will therefore require separate and dedicated mass counterbalance pressure monitoring and control of the above type. In preferred embodiments, including multiple actuator use, the control system of the present invention may provide this multiple actuator monitoring and control function.

Most preferably, the present invention provides what is known in the art as a "maintained, closed loop system". That is to say, the present invention most preferably comprises a closed fluid supply loop or loops in which properties of the supplied fluid (e.g. pressure) are maintained in the/a loop. Most preferably, within the closed loop system there are two control loops: a first control loop arranged for controlling actuator position/speed; and, a second control loop for controlling mass counterbalance (e.g. fluid pressure).

For example, the first fluid transfer means may be included within the first control loop, and the second fluid transfer means may be included within the second control loop.

A hydraulic accumulator may be provided in the first control loop (e.g. as part of the first fluid transfer means) for the purposes of supplying fluid to the first fluid transfer means. A hydraulic accumulator may be provided in the second control loop (e.g. as part of the second fluid transfer means) for the purposes of pressurising fluid to the actuator chamber. The hydraulic accumulator employed in the first control loop may be the same hydraulic accumulator employed in the second control loop, and may thus be a mutual component or fluid link between the two control loops.

Preferably, the supplied fluid pressure is determined/adjusted so as to maintain equilibrium between the force exerted by the actuator and the (typically varying) force experienced by it from the load. Fluid pressure variations may be achieved automatically by virtue of changes in the volume of (and therefore the pressure of) of the fluid stored within the hydraulic accumulator. Thus, at least short-term fluid pressure variations may be implemented by suitably controlling the volume of fluid supplied to the hydraulic accumulator which supplies fluid to the actuator chamber. Long-term pressure variations may be put into effect using additional fluid pressure generation means, such as fluid pumps etc.

Preferably, the control system includes (and is responsive to sensing signals from) first sensor means for sensing the position and/or velocity of the/each actuator rod controlled thereby, and second sensor means for sensing the pressure of pressurised fluid for supply to the/each actuator chamber. The first sensor means of the control system preferably form a part of the first control loop, while second sensor means preferably form a part of the second control loop.

The first and second control loops may be separately operable such that mass counterbalance (fluid pressure) and actuator rod position/speed may be controlled separately. Preferably, in aspects of the present invention where a plurality of actuators are employed in tandem (e.g. on a motion simulator platform), each actuator has associated with it a dedicated hydraulic accumulator which forms part of the first control loop of the control system for that actuator, while a second common control loop is provided to serve each of the plurality of actuators and is in fluid communication with each actuator via the dedicated hydraulic accumulator thereof.

The control system most preferably controls the second fluid transfer means thereof (e.g. the second control loop of the/each actuator) to supply pressurised fluid to the hydraulic accumulator associated with the first fluid transfer means (e.g. the first control loop) at a pressure commensurate with both the load experienced by the actuator and the fluid pressure changes induced by changes in the geometry (e.g. orientation or position) of the motion simulation system as a whole, within which the actuator is employed.

Most preferably, the hydraulic accumulator if the first fluid transfer means is supplied/charged with pressurised fluid by the second fluid transfer means, pressure in the supplied fluid being generated by a fluid pump within the second fluid transfer means (e.g. part of the second control loop).

The second fluid transfer means may generate a desired predetermined variable fluid pressure for supply to the hydraulic accumulator of the first fluid transfer means via fluid control valves (e.g. flow control valves) controlled by the control means to control the pressure of the fluid supplied thereby to the hydraulic accumulator being supplied. This also enables multiple hydraulic accumulators (e.g. of multiple separate actuators in a multi-actuator system) to be supplied by the same second fluid transfer means. The control of the pressure of fluid supplied to each may be done using separate fluid control valves for each actuator being supplied. A single fluid pump within the second fluid transfer means may be employed to generate (i.e. "pre-charge") the fluid to the first fluid transfer means of a plurality of separate actuators within a multi-actuator motion platform, or the like.

Of course, the fluid supply means is most preferably operable to control the mutual fluid pressure of the fluid supplied thereby to the extend and retract chambers to be sufficient to enable the actuator to support a load applied to the actuator in use. Preferably, the fluid supply means is arranged to reversibly transfer aforesaid pressurised fluid between the extend and retract chambers of the actuator, and to separately and independently reversibly transfer aforesaid pressurised fluid between the extend chamber and a pressurised fluid store means. Thus, movement of the actuator piston within the actuator chamber of the differential actuator results in different rates of volumetric change as between the extend and retract chambers. Accordingly, the fluid supply means is preferably arranged to transfer between the extend and retract chambers volumes of pressurised fluid substantially equal to a change in the volume of the retract chamber. The fluid supply means is most preferably arranged to simultaneously transfer to and from the extend chamber volumes of pressurised fluid substantially equal to the change in the volume of the extend chamber less the concurrent change in the volume of the retract chamber.

Preferably, the actuator includes a first fluid transfer means in fluid communication with the extend chamber and the retract chamber and arranged to transfer therebetween volumes of fluid substantially equal in magnitude to changes in the volume of the retract chamber resulting from movement of the actuator piston within the actuator chamber;

and a second fluid transfer means in fluid communication with the extend chamber and operable to transfer to and from the extend chamber volumes of fluid substantially equal in magnitude to the difference between said changes in the volume of the retract chamber and concurrent changes in the volume of the extend chamber.

Thus, a double-acting actuator chamber may be provided in which the actuator is powered by transferring fluid directly from the extend chamber to the retract chamber (or vice versa) together with a concurrent transfer of fluid from (or to) the extend chamber matching the overall change in the combined volume of the extend and retract chambers due to extension/retraction of the actuator rod. This separate fluid transfer arrangement has been found to require much lower energy inputs to operate as compared to the existing method of valves metering high-pressure fluid to/from an actuator chamber.

Most preferably, one or both of the first and second fluid transfer means employs a fluid/hydraulic pump or pumps. The fluid transfer means may employ two pumps each operable to pump fluid in one of two opposite directions thereby, in combination, forming a bi-directional pump. Alternatively, the first and/or second fluid transfer means is preferably a single reversible fluid pump. Preferably, the second fluid transfer means is a reversible (or bi-directional) second fluid pump whereby the second pump is arranged to pump fluid at a volumetric rate determined according to the volumetric pump rate of the first pump. Preferably, volumetric rate of the second pump is determined according to that of the first pump such that transfer of fluid from (or to) the extend chamber matches the overall change in the combined volume of the extend and retract chambers due to extension/retraction of the actuator rod.

Where the actuator chamber, actuator piston and those parts of the actuator rod within the actuator chamber define a retract chamber of substantially annular volume, the first and second pumps are preferably arranged such that the ratio of the concurrent volumetric pump rates of the second and first pumps is substantially equal to the ratio of: changes in the volume of those parts of the actuator rod within the retract chamber; and, the corresponding changes in the annular volume of the retract chamber. This ensures that concurrent changes in the volumes of the extend and retract chambers are matched to the volumes of fluid being transferred thereto or therefrom by the separate first and second pumps.

Most preferably, the fluid supply means is operable to supply fluid to the extend and retract chambers of the actuator at a pressure sufficient to enable to support at least the static mass of the actuator load (e.g. vehicle simulator platform). Most preferably, the actuator is operable to control the fluid transfer means to transfer pressurised fluid to enable the actuator to support/drive inertial loads applied to the actuator in use (e.g. inertial forces arising through movement of a vehicle simulator platform). Such transfer of pressurised fluid by the fluid transfer means need only be done "on demand" and the fluid transfer means need not itself generate the pressure present within the fluid it transfers which is needed to support the static load of the actuator.

Any tendency of the actuator rod to overshoot the position demanded of it would result in an overshoot in the internal position of the actuator piston within the actuator chamber. Consequently, more pressurised fluid would be urged to leave the extend chamber than desired. The present invention may provide a mass counterbalance function without the use of a valve, but rather, by use of the application of back-pressure at the fluid output from the second fluid transfer means from which fluid is output in response to contraction of the extend chamber, so as to partially resist the output of that fluid therefrom. In this way, the tendency to over-retraction of the actuator rod, which corresponds with an urging of fluid from the extend chamber, is at least partially resisted and is thereby damped or counterbalanced.

Furthermore, when a fluid pump is employed as the second fluid transfer means to transfer fluid from the extend chamber, the urging of an ejection of an excess of fluid from the extend chamber (a result of "overshoot") would urge the second fluid transfer means to transfer fluid (i.e. pump) at a rate greater than the rate at which the actuator controls the transfer means to operate. The actuator is arranged to resist this urging and thereby to provide a mass counter-balance effect by applying a torque to the drive motor of the pump of the second fluid transfer means which opposes the torque applied thereto by the urging pressure from the extend chamber. In addition, the back-pressure applied to the output of the second fluid transfer pump also applies a similarly resistive torque to the pump by urging the pump to back-drive in response to the back-pressure.

Preferably, the second fluid transfer means is in fluid communication with a fluid vessel and is arranged to transfer fluid from the extend chamber to the fluid vessel and vice versa, wherein the fluid vessel is arranged to hold fluid received thereby from the second fluid transfer means in a state sufficiently pressurised to generate a back-pressure upon the second fluid transfer means which partially resists the flow of fluid from the second fluid transfer means to the fluid vessel.

For example, the fluid vessel may be a hydraulic accumulator and a fluid conduit connecting the second fluid transfer means in fluid communication with, and terminating at, a hydraulic accumulator.

The second transfer means is most preferably a reversible fluid pump and said fluid vessel is arranged to generate said back-pressure being sufficient to urge the reversible fluid pump of the second transfer means to back-drive thereby to urge the pump to operate to pump fluid from the fluid vessel to the extend chamber. In this way, the over-retraction of the actuator rod, which corresponds with an over-contraction in the volume of the extend chamber, is at least partially resisted and is thereby damped or counterbalanced.

Thus, an inherent mass counterbalance function is provided without the use of a counterbalance valve. Moreover because the mass counterbalance pressure is transferred between the fluid vessel and the extend chamber via a servo controlled, reversible pump, the stiffness of the counterbalance system is very high when compared to the compressible gas systems which are often used. This stiffness imparts high stability of the supported mass.

The fluid vessel is preferably operable to be in fluid communication with said first fluid transfer means via said second fluid transfer means. This enables losses of fluid, through leakage and the like, from either the retract or extend chamber, of from either of the first and second fluid transfer means to be replenished easily with fluid from the fluid vessel.

Furthermore, the fluid supply means of the actuator may include a fluid reservoir for use in supplying pressurised fluid to the fluid vessel, the first fluid transfer means, the second fluid transfer means, and the actuator chamber.

The fluid supply means of the actuator is arranged to supply fluid at an equal pressure to both sides of the actuator piston. The actuator behaves as a simple "displacement" (or "single acting") actuator, and generates a force equal to the pressure of the supplied fluid multiplied by the difference in area between the head-side (extend chamber side) and rod-side (retract chamber side) of the actuator piston (i.e. the area of the rod-side piston surface taken up by the actuator rod).

Where, in the present invention, there exists a leakage path of pressurised fluid from/into the retract chamber or the extend chamber of the actuator, the result may be an undesired pressure differential as between the preferably equally pressurised extend and retract chambers of the actuator and a consequent movement of the actuator rod. Preferably, the fluid transfer means is arranged to maintain a given desired static position of the actuator rod by transferring pressurised fluid to-from the extend and/or retract chamber as required to maintain the mutual fluid pressure therein and thereby to maintain the given desired static position of the actuator rod.

The present invention, in a second of its aspects, may provide a motion platform for a vehicle motion simulator machine including an actuator according to the invention in its first aspect including none some or all of the variants and preferable features discussed above.

Furthermore, the invention is a third of its aspects may provide a vehicle motion simulator including a motion platform according to the invention in its second aspect.

It is to be understood that the invention is any of its first, second or third aspects represents the implementation of a method of actuation, or vehicle motion simulation respectively.

Accordingly, in a fourth of its aspects, the present invention may provide a method of actuation for use with an actuator having an actuator chamber containing a moveable actuator piston and an actuator rod connected to the actuator piston and retractably extendable from the actuator, the actuator chamber and actuator piston defining an extend chamber and a retract chamber separated from the extend chamber by the actuator piston such that the actuator rod extends through the retract chamber, the method including:

supplying fluid simultaneously to both the extend and retract chamber at substantially the same pressure and reversibly transferring said pressurised fluid between the extend and retract chambers of the actuator.

Preferably, the pressure of the pressurised fluid simultaneously supplied to extend and retract chambers is determined according to the load being experienced by the actuator. The pressure of the pressurised fluid simultaneously supplied to extend and retract chambers is preferably determined according to the position/extension of the actuator rod of the actuator. Most preferably, the pressure is controlled to maintain equilibrium between the actuator and its load.

The step of supplying fluid preferably includes reversibly transferring the pressurised fluid between the extend and retract chambers in a first fluid transfer step, and generating pressure in the fluid separately in a second fluid transfer step for reversibly transferring pressurised fluid to the actuator chamber. These two steps may be done in any order and may be done simultaneously, or generally concurrently.

Most preferably, the second fluid transfer step includes storing fluid for supply to the actuator chamber and controllably generating a fluid pressure therein. For example, a pressurising fluid store may be used, comprising a fluid reservoir in fluid communication with a fluid pump for pumping fluid from the fluid reservoir to the actuator chamber in a pressurised state. Alternatively, or additionally, a suitable hydraulic accumulator may be employed, e.g. being of a type readily apparent to the skilled person.

In this way, the fluid supply step may comprise two parts: a first which is concerned with the transfer of fluid between the extend and retract chambers of the actuator and which, therefore, is a means via which the position of the actuator rod (i.e. extent of retraction/extension) and/or the rate/speed of changes in its position may be controlled; a second part which is concerned with the supply of pressurised fluid to the actuator chamber and is a means via which one may control the force with which the actuator resists a load in use, since it is the value of the pressure in the pressurised fluid supplied to the actuator chamber which determines this force. This force/pressure controllability enables the actuator to provide an effective variable mass counterbalance system to variably counterbalance changing load values in use.

The two parts of the fluid supply step may be controlled separately and independently, or in tandem, in use to provide the desired effect in the actuator.

The present invention preferably includes controlling the operation of the actuator either alone or in combination with a plurality of such actuators acting in concert in a motion simulator platform or the like. Preferably the control of the actuator(s) is done by suitably controlling the transfer of fluid to and from the extend and retract chambers of the actuator chamber to control the extension/retraction position and/or speed of the actuator rod while also controlling the pressure of the fluid supplied to the actuator chamber so as to control the force exerted by the actuator rod.

Preferably, the control method includes monitoring the load force to which the actuator is subjected by the load applied to the actuator in use, and controlling (e.g. at the second fluid transfer step) the pressure in the pressurised fluid supplied to the actuator chamber in response to variations in the load force.

Most preferably, where pressurised fluid is supplied via a hydraulic accumulator, the supplied fluid pressure is varied/controlled by varying/controlling the fluid pressure and/or volume within the accumulator. Additional methods for pressure variation/control may be employed (e.g. use of fluid pumps, fluid flow control valves etc).

Preferably, the supplied fluid pressure is determined/adjusted so as to maintain equilibrium between the force exerted by the actuator and the (typically varying) force experienced by it from the load. Fluid pressure adjustments may be implemented by suitably controlling the volume of fluid supplied to the hydraulic accumulator which supplies fluid to the actuator chamber. Long-term pressure variations may be put into effect using additional fluid pressure generation means, such as fluid pumps etc.

Preferably, the control step includes sensing the position and/or velocity of the/each actuator rod controlled thereby, and sensing the pressure of pressurised fluid for supply to the/each actuator chamber.

Mass counterbalance (fluid pressure) and actuator rod position/speed may be controlled separately. Preferably, in aspects of the present invention where a plurality of actuators are employed in tandem (e.g. on a motion simulator platform), the method includes providing each actuator a dedicated hydraulic accumulator therewith to feed separately each actuator, while supplying fluid to the plurality of accumulators from a common fluid store and controlling the pressure generated by each accumulator via the common fluid store.

The control step most preferably includes controlling the supply of pressurised fluid to the actuator chamber to be at a fluid pressure commensurate with both the load experienced by the actuator and the fluid pressure changes induced by changes in the geometry (e.g. orientation or position) of e.g. the motion simulation system as a whole, within which the actuator is employed. The control of the pressure of fluid supplied to the/each actuator chamber may be done using separate fluid control valves for each actuator being supplied. A single fluid pump within the second fluid transfer means may be employed to generate (i.e. "pre-charge") the fluid to the first fluid transfer means of a plurality of separate actuators within a multi-actuator motion platform, or the like.

Most preferably, the method includes controlling the mutual fluid pressure of the fluid supplied to the extend and retract chambers to be sufficient to enable the actuator to support a load applied to the actuator in use.

Preferably, the method includes reversibly transferring aforesaid pressurised fluid between the extend and retract chambers of the actuator, and separately and independently reversibly transferring aforesaid pressurised fluid between the extend chamber and a pressurised fluid store means.

Accordingly, the method preferably includes transferring between the extend and retract chambers volumes of pressurised fluid substantially equal to a change in the volume of the retract chamber. Most preferably includes simultaneously transferring to and from the extend chamber volumes of pressurised fluid substantially equal to the change in the volume of the extend chamber less the concurrent change in the volume of the retract chamber.

Preferably, the method includes transferring between the extend chamber and the retract chamber volumes of fluid substantially equal in magnitude to changes in the volume of the retract chamber resulting from movement of the actuator piston within the actuator chamber; and, transferring to and from the extend chamber volumes of fluid substantially equal in magnitude to the difference between said changes in the volume of the retract chamber and concurrent changes in the volume of the extend chamber.

Preferably, fluid is transferred between the extend chamber and the retract chamber by the reversible pumping thereof at a first volumetric pump rate, and fluid is transferred to and from the retract chamber by the reversible pumping thereof at a second volumetric pump rate determined according to the first volumetric pump rate.

Preferably, the actuator chamber, actuator piston and those parts of the actuator rod within the actuator chamber define a retract chamber of substantially annular volume, whereby the ratio of the concurrent second and first volumetric pump rates is substantially equal to the ratio of: changes in the volume of those parts of the actuator rod within the retract chamber; and, the corresponding changes in the annular volume of the retract chamber.

Most preferably, the method includes supplying fluid to the extend and retract chambers of the actuator at a pressure sufficient to enable to support at least the static mass of the actuator load (e.g. vehicle simulator platform). Most preferably, the method further includes transferring pressurised fluid to enable the actuator to support/drive inertial loads applied to the actuator in use (e.g. inertial forces arising through movement of a vehicle simulator platform).

The method preferably includes applying a back-pressure at the fluid output from the second fluid transfer means from which fluid is output in response to contraction of the extend chamber, so as to partially resist the output of that fluid therefrom.

The method preferably includes providing a mass counterbalance effect by providing a reversible fluid pump for implementing the aforesaid second volumetric pumping rate, and applying a torque to the drive motor of the fluid pump which opposes the torque applied thereto by the fluid pressure from the extend chamber felt at the fluid pump.

The method preferably includes holding fluid transferred from, or to be transferred to, the extend chamber in a state sufficiently pressurised to generate a back-pressure which partially resists the transfer of fluid from the extend chamber.

More preferably, the method includes providing the aforesaid reversible fluid pump arranged to perform said transfer of fluid to and from the extend chamber by pumping said fluid, and generating said back-pressure to be sufficient to urge the reversible fluid pump to back-drive thereby to urge the pump to operate to pump said held fluid to the extend chamber.

In a fifth of its aspects the present invention may provide a method of simulating motion in a vehicle simulator machine using the method of actuation according to the invention in its fourth aspect.

Non-limiting examples of the invention shall now be described with reference to the accompanying drawings in which:

FIG. 1 illustrates a system of actuators providing a motion system for a vehicle motion simulator;

FIG. 2 schematically illustrates the relative volumetric fluid pumping rates of a first and second reversible hydraulic pumps;

Figure 6:
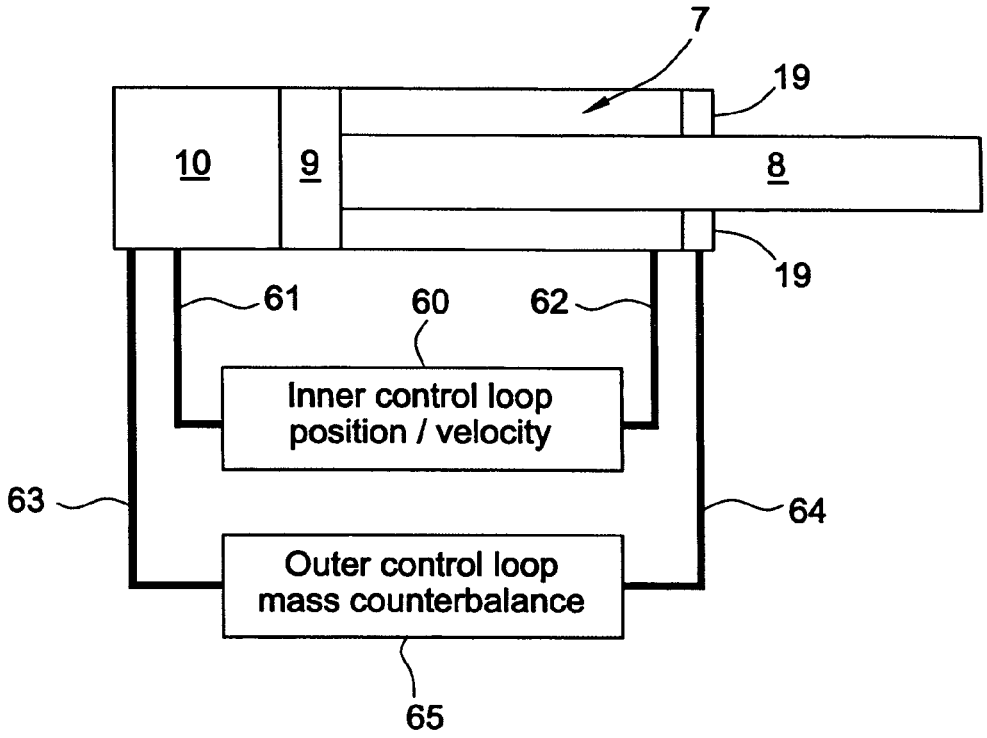

FIG. 6 schematically illustrates the arrangement of control functions in an actuator, employing a first control loop for actuator position/velocity control, and a second control loop for fluid pressure and mass counterbalance control.

Figure 5:
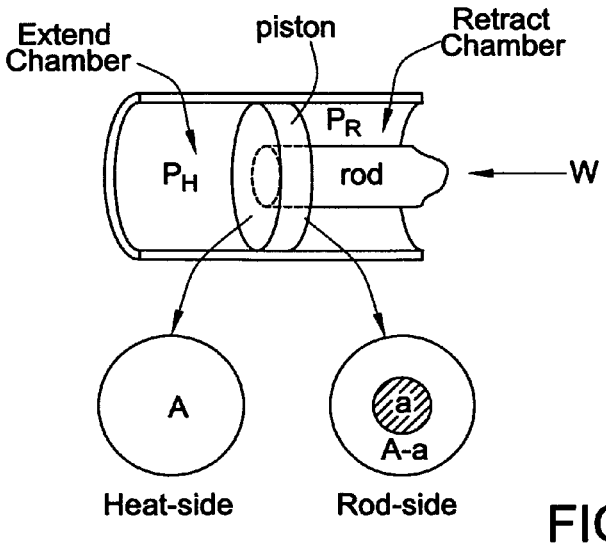
FIG. 5 illustrates schematically the rod-side (retract chamber) and head-side (extend chamber) piston areas of a double-acting differential actuator chamber.

Referring to FIG. 5 there is schematically illustrated the internal components of a double-acting differential actuator chamber. The actuator chamber comprises a chamber split by a piston into an extend chamber and a retract chamber. An actuator rod extends from the "rod-side" of the piston through the retract chamber. No such rod extends through the "head-side" of the extend chamber thereby rendering the actuator "differential" in the sense that the available head-side piston area A upon which fluid within the extend chamber of pressure $P_H$ can act, is greater than the available head-side piston area (A-a) upon which fluid within the retract chamber of pressure $P_R$ can act. The difference in area is the area "a" of the rod-side piston taken-up by the actuator rod. Consider the actuator of FIG. 5 supporting a load W. In equilibrium, the balance of load and pressures gives:

$$P_H A = P_R(A-a) + W$$

Setting the rod-side and head-side pressures to be equal (i.e. $P_H = P_R$) gives:

$$P_H = P_R = \frac{W}{a}$$

Thus, the load W is supported by applying equal fluid pressure to both the rod-side and head-side of the actuator, the mutual pressure being equal to the magnitude of the load force W supported by the actuator, divided by the area of the actuator rod. It will be appreciated that equal extend and return forces (magnitudes P(A-a) and Pa respectively) are achieved when A=2a.

Figure 3:
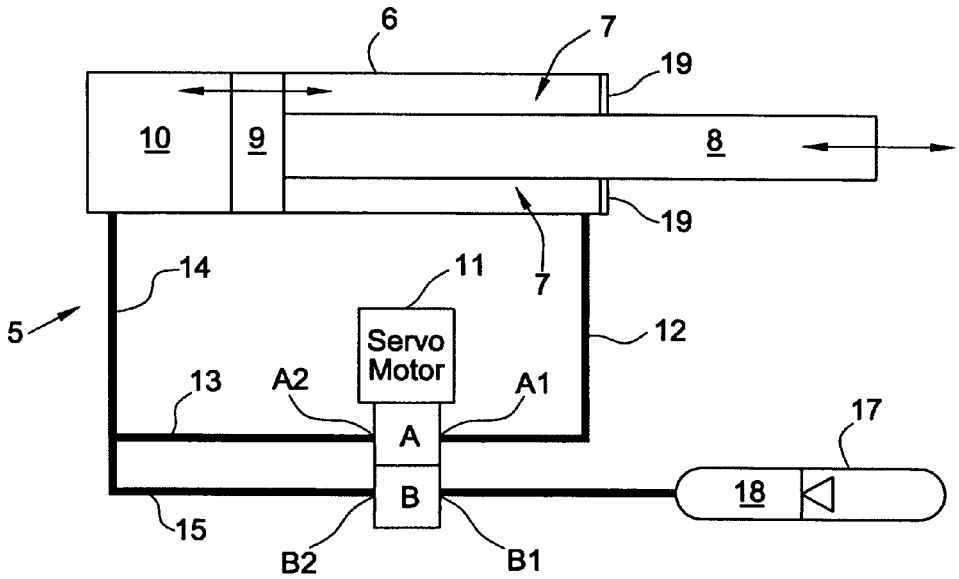
FIG. 3 illustrates a hydraulic actuator system with a hydraulic accumulator.

Referring to FIG. 3 there is shown a schematic illustration of an actuator system 5 according to an embodiment of the present invention. The actuator system 5 includes an actuator cylinder 6 possessing an internal cylindrical actuator chamber containing an actuator piston 9 to which is connected an actuator rod 8. The actuator piston is formed to closely, but slideably, fit against the internal cylindrical walls of the actuator chamber which oppose it so as to partition the actuator chamber into a retract chamber 7 and an extend chamber 10 separated from the retract chamber 7 by the actuator piston. The piston is able to slide along the cylindrical against the internal walls of the actuator chamber along the cylindrical axis thereof so as to produce changes in the volumes of the extend and retract chambers of the actuator.

The actuator rod 8 extends from the actuator piston 9 through the retract chamber along the cylindrical axis of the actuator chamber, through an end wall 19 thereof and outwardly of the actuator cylinder 6. The actuator cylinder forms a sealing fit against those parts of the actuator rod which extend through the end wall 19 of the retract chamber.

Sliding movement of the actuator piston within the actuator chamber results in a corresponding retraction or extension of the actuator rod to/from the actuator cylinder 6 as the piston is slid away from or towards the end wall 19 of the retract chamber 19 through which the actuator rod 8 extends. Thus, control of the position of the actuator piston 9 within the "double acting" actuator chamber (7, 10) of the actuator controls the retraction/extension of the actuator rod 8.

A first fluid transfer means, in the form of a reversible first hydraulic pump (A), is placed in fluid communication with the extend chamber and the retract chamber via a fluid conduit 12 extending from the retract chamber to a fluid port A1 of the first pump, and via a further fluid conduit (13, 14) extending from a second fluid port A2 of the first pump and terminating at the extend chamber 10 of the actuator. The first pump is arranged to transfer, between the extend and retract chambers via the fluid conduits, volumes of fluid substantially equal in magnitude to changes in the volume of the retract chamber resulting from movement of the actuator piston within the actuator chamber.

A second fluid transfer means is provided in the form of a reversible hydraulic pump (B) in fluid communication with the extend chamber 10 via a fluid conduit (14, 15) extending from the extend chamber to a fluid port B2 of the second pump. The second pump is operable to transfer to and from the extend chamber volumes of fluid substantially equal in magnitude to the difference between said changes in the volume of the retract chamber and concurrent changes in the volume of the extend chamber. Any suitable type of fluid pump may be used, such as would be readily apparent to the skilled person for example.

The actuator is powered by transferring fluid directly from the extend chamber to the retract chamber (or vice versa) together with a concurrent transfer of fluid from (or to) the extend chamber matching the overall change in the combined volume of the extend and retract chambers due to extension/retraction of the actuator rod. This separate fluid transfer arrangement is performed by the pumping of fluid using the reversible first and second pumps (A, B) to control the rate and direction of fluid flow to and from the extend and retract chambers of the actuator.

The two reversible pumps are powered by a common electrical servo motor 11 which is suitably geared to ensure that the second fluid pump B pumps fluid at a volumetric rate determined according to that of the first pump such that transfer of fluid from (or to) the extend chamber matches the overall change in the combined volume of the extend and retract chambers due to extension or retraction of the actuator rod.

This arrangement may employ any type of pump. Ideally the extend chamber volume will be twice the retract chamber volume (i.e. A/a=2, see FIG. 5), but where there is a volumetric deviation from this ideal state one may either use gearing to match the outputs from two equal pumps to the non-ideal actuator displacement, or have specially matched pumps, or manage small (e.g. less than 5%) differences with the leakage flow into the retract chamber from the hydrostatic bearing feed 32 in FIG. 4.

Figure 2:
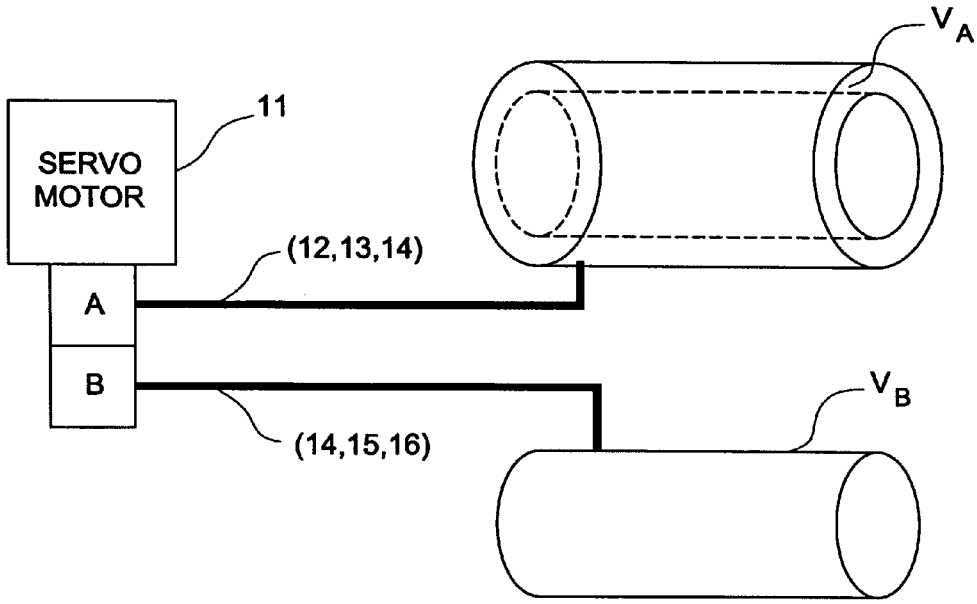

FIG. 2 schematically illustrates the relationship between the pump rates of the first and second pumps (A, B). The actuator chamber, actuator piston 9 and those parts of the actuator rod 8 within the actuator chamber define a retract chamber 7 of substantially annular volume $V_A$ which is available for occupation by hydraulic fluid. Correspondingly, those parts of the actuator rod within the retract chamber occupy a volume $V_B$ of the retract chamber which is unavailable for occupation by hydraulic fluid. The first pump A and second pump B are arranged such that the ratio of the concurrent volumetric pump rates ($R_B/R_A$) of the second (B) and first (A) pumps is substantially equal to the ratio ($V_B/V_A$) of: changes in the volume ($V_B$) of those parts of the actuator rod within the retract chamber; and, the corresponding changes in the annular volume ($V_A$) of the retract chamber (i.e. $R_B=(V_B/V_A)\ R_A$).

Consequently, concurrent changes in the volumes of the extend and retract chambers are matched to the volumes of fluid being transferred thereto or therefrom by the separate first and second pumps.

Referring to FIG. 3, the actuator system illustrated therein possesses a hydraulic accumulator 17 having a pressurised fluid storage chamber 18 in fluid communication, via a fluid conduit 16, with the fluid port B1 of the second pump B remote from the extend chamber 10 of the actuator. The second pump is a reversible fluid pump and the hydraulic accumulator is arranged to receive/supply fluid from/to the second fluid pump in response to contraction/expansion of the extend chamber. The accumulator generates a back-pressure within the fluid supplied by it to the second fluid pump B which is sufficient to urge the reversible second fluid pump to back-drive thereby to urge the pump to operate to pump fluid from the accumulator to the extend chamber (this also assists the mutually-driven [common motor 11] pump A to transfer fluid from the retract chamber to the extend chamber). In this way, the over-retraction of the actuator rod, which corresponds with an over-contraction in the volume of the extend chamber, is at least partially resisted and is thereby damped or counterbalanced. A mass counterbalance function is thereby provided by use of the application of pressure to hydraulic fluid output from fluid port B1 of the second pump B, this output fluid being fluid transferred from the extend chamber 10 by the second pump B resulting in retraction of the actuator rod 8.

Furthermore, the pressurised fluid at the fluid port B1 of the second pump remote from the extend chamber also partially resists the output of fluid from the fluid port B1 to the accumulator chamber 18 communicating with that port. In this way, the tendency to over-retraction of the actuator rod, which corresponds with an urging of fluid from the extend chamber, is at least partially resisted and is thereby damped or counterbalanced.

The hydraulic accumulator 17 is in fluid communication with the first fluid pump A via the second fluid pump B and the intermediate fluid conduits (13,14,15) connecting the first and second pumps mutually to the extend chamber 10. Losses of fluid, through leakage and the like, from either the retract or extend chamber, of from either of the first and second fluid pumps may be replenished easily with fluid from the hydraulic accumulator 17.

The direction and rate of fluid flow from/to the extend and retract chambers of the actuator is controlled by the direction and rate of pumping of the first and second reversible pumps (A, B). These are powered by the servo motor 11 which delivers power concurrently to each of the first and second pumps via a transmission system (not shown) suitably geared to put effect to the different concurrent volumetric pump rates of the two pumps in use.

Figure 4:
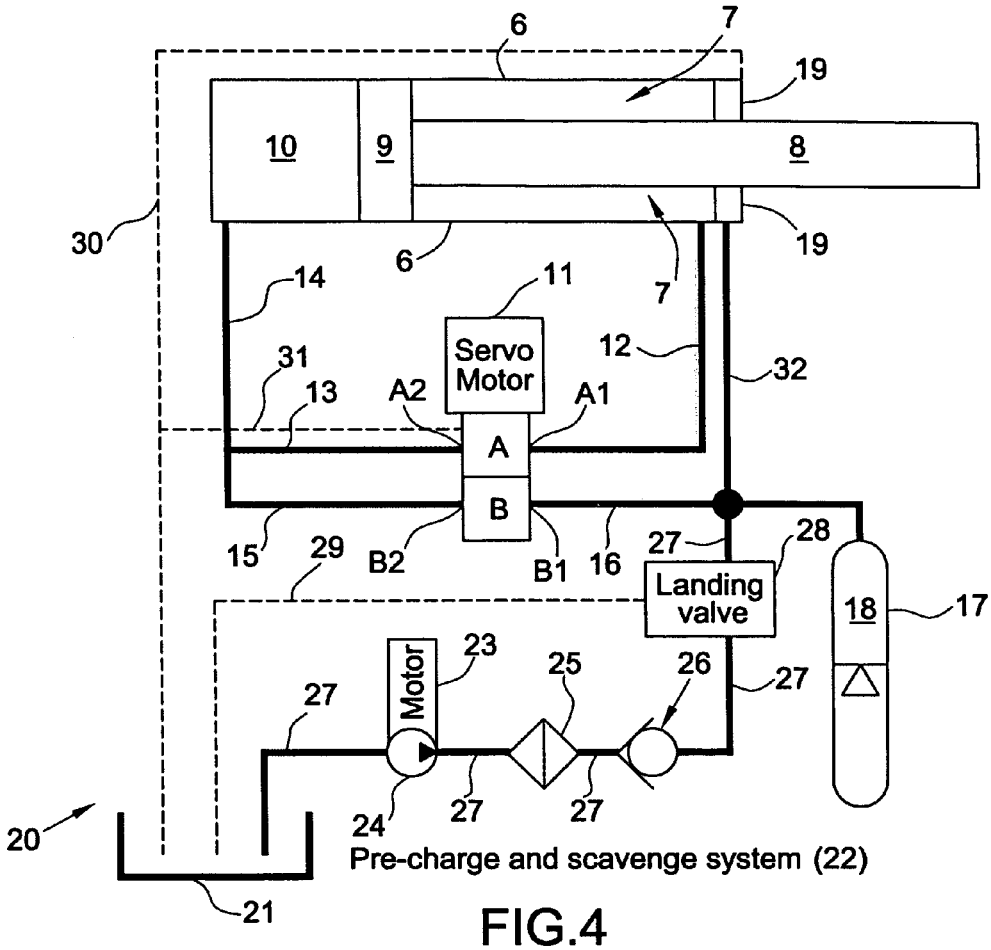
FIG. 4 illustrates a hydraulic actuator system including a fluid pre-charging system.

FIG. 4 illustrates a further embodiment of the present invention comprising all of the features of the embodiment illustrated in FIG. 3. Like elements in FIGS. 3 and 4 share a common reference symbol.

The actuator system of FIG. 4 includes a fluid supply collectively denoted 20, which is arranged to be in fluid communication with and to supply pressurised fluid to the hydraulic accumulator 17, the first fluid pump A, the second fluid pump B, and the hydrostatic bearing of the actuator cylinder 6. The fluid supply includes a fluid reservoir 21 and a fluid conduit 27 which places the fluid reservoir 21 in fluid communication directly with the fluid conduit 16 which connects the hydraulic accumulator in fluid communication with the fluid port B1 of the second pump B remote from the extend chamber of the actuator. In this way, the fluid reservoir is operable to be placed in fluid communication with the rest of the actuator fluid circuit.

Included within the fluid supply 20 is a pre-charge system 22 arranged to pressurise fluid supplied by the fluid supply 20 to the rest of the actuator system. The pre-charge system includes a pre-charge fluid pump 24 powered by an electrical servo motor 23 and arranged within the fluid conduit 27 of the fluid supply system to transfer fluid from the fluid reservoir 21 and into and along the fluid conduit 27 of the fluid supply system to the other parts of the actuator fluid circuit with which the fluid reservoir is in fluid communication. Arranged in series along the fluid conduit 27 of the fluid supply system, subsequent to the pre-charge fluid pump 24 thereon, are a fluid filter 25 for filtering hydraulic fluid output by the pre-charge pump 24, and a one-way valve 26 arranged to receive filtered hydraulic fluid output by the fluid filter 25 and to pass such filtered fluid to (but not admit fluid from) the up-stream section of the fluid conduit, and a landing valve unit 28 arranged to receive filtered fluid output by the one-way valve 26.

The landing valve unit 28 is solenoid operated so that either software or manual (emergency or maintenance) switching can take control of the landing sequence, i.e. returning the simulator to its rest state—all actuators fully retracted—from some previous 'flying state' so that crew members may disembark.

Essentially the landing valve is a solenoid-operated check-valve with a one-way flow restrictor applied to the oil being exhausted from the actuator chamber 10.

In normal use, neither the check-valve nor flow restrictor are in the fluid circuit, and the landing valve permits free flow from pump 24 and maintains the drain line 29 closed.

The landing valve is often necessary as there is full mass counter balance and in the event of power loss the stored pressure in the accumulator will maintain the 'flying' height of the simulator with the danger that pressure in one or more of the 6 motion actuators may lose pressure before the rest, resulting in potentially extreme listing over an extended period before finally settling. As a second function, the landing valve will fully deplete the mass counterbalance system rendering it safe to work on during maintenance.

Leakage fluid conduits 29, 30 and 31 place the landing valve 28, the first and second fluid pumps (A, B), and fluid seals (not shown) within the end wall 19 of the retract chamber 7, in fluid communication with the fluid reservoir 21 of the fluid supply system 21 respectively.

The leakage fluid conduits 29, 30 or 31, are placed in such suitable fluid communication with the landing valve 28, the first and second fluid pumps (A, B), or fluid seals within the end wall 19 of the retract chamber 7, as the case may be, so as to enable hydraulic fluid which leaks from those components during use of the actuator to be collected at the fluid reservoir 21 of the fluid supply system for ultimate return to the fluid circuit of the actuator.

It is to be noted that the actuator system illustrated in FIG. 4 may be modified, in a further embodiment of the present invention, such that the hydraulic accumulator 17 of the system is placed in fluid communication with the fluid circuit of the actuator at a point along the fluid conduit 27 of the fluid supply system between the one-way valve 26 and the landing valve 28 thereof. In this way, the hydraulic accumulator may be integrated as a part of the fluid supply unit of the actuator system as a whole, rather than being separate (but not separated) from the fluid supply unit as is the case in the embodiment illustrated in FIG. 4. The advantage of this alternative arrangement lies in the ability of the fluid supply unit 20 (including a single hydraulic accumulator arranged as discussed above) to supply hydraulic fluid to a plurality of separate actuator cylinders 6 and a plurality of associated first and second fluid pumps (A,B). This obviates the need not only for a fluid supply unit for each of the plurality of actuator cylinders (and their pumps), but also obviates the need for a corresponding plurality of separate dedicated hydraulic accumulators.

The end wall 19 includes a hydrostatic gland bearing arranged to provide a sealing bearing surface for the actuator rod 8 extending from the actuator. The function of conduit 32 in FIG. 4 is to supply a hydrostatic gland bearing (at end wall 19) with pressurised oil essential for its correct functioning. This bearing supports the rod 8 concentrically to the primary bore of the actuator by means of a very thin film of oil maintained by a constant flow of pressurised oil, similar to plain bearings on an engine crankshaft but working to much smaller clearances and flow. This arrangement contributes the smallest possible frictional drag.

A system pressure feed, in this case from the pre-charge system 20 (pump 24 & accumulator 17) is applied to the centre of the bearing, where the clearance is greatest, and flows in both directions, into the annular chamber 7 if pressure in there is lower and also to the drain line 30. Residual oil in the gland is sealed by a low friction elastomeric seal and this residual leakage is also returned to reservior via drain line 30. The two leakage paths are shown on FIG. 4.

Leakage can also occur from chamber 7 into feed line 32 if the pressure in chamber 7 is higher. It is this interchange of fluid at the hydrostatic bearing which prevents very high peak pressures being generated in chamber 7 as a result of small volumetric errors that might occur through leakage or pump wear.

To summarise, beneficial effects of the pre-charge system 20 are:

A Pressure spikes in chamber 7 are trimmed through leakage past the bearing into line 32;

B At zero or small motion activity the leakage flow will stabilise pressures in both sides of the actuator i.e. chambers 7 & 10. Therefore there will be no leakage across piston 9 nor from line 32 into chamber 7;

C Leakage i.e. inefficiency is therefore restricted to leakage from line 32 across the bearing into drain line 30. Obviously this leakage path should be kept as small as possible, consistent with the correct functioning of the bearing.

The connection of pump B to an accumulator allows the differential volume between the extend and retract chambers to be displaced into the accumulator at a pressure. The stored pressure will backdrive pump B so that it behaves as a motor whenever the pressure in conduit 15 is less than in conduit 16. The pre-charge unit will pressurise the system until full mass counterbalance of the suspended load is achieved. In this state little or no input power from the servo motor (via pumps A & B) will be needed and significant energy savings can be made.

FIG. 6 schematically illustrates an arrangement of control functions in an actuator according to a preferred embodiment, employing a first "inner" control loop 60 for actuator position/velocity control, and a second "outer" control loop 65 for fluid pressure and mass counterbalance control. The inner control loop 60 comprises, for example, the servo motor 11, fluid pumps A and B (see FIG. 4), and fluid conduits 12 to 16 (collectively represented by conduits 61 and 62 in FIG. 6) which place the two pumps A and B in fluid communication with the chambers of the actuator and which are used to transfer fluid between the extend and retract chambers of the actuator as discussed above with reference to FIG. 4. The inner control loop also includes the hydraulic accumulator 17 which serves not only to supply and receive fluid to the fluid pump B serving the extend chamber of the actuator, but also serves to pre-charge/pressurise the fluid so supplied thereby to assist in mass counterbalance as discussed above. The inner control loop also includes fluid pressure sensors and position sensors (not shown) arranged at suitable locations within the actuator assembly to monitor the fluid pressure and actuator rod extension/velocity, respectively. The pressure and transfer of fluid by the first control loop is controlled, in response to the measured values provided by the pressure and position sensors, to either maintain equilibrium between the actuator and its load, or to produce any other desired response in the actuator.

The outer control loop 65 comprises, in this example, the pre-charge and scavenge system 22 illustrated in FIG. 4 and discussed above. That is to say, the fluid supply 20, the pre-charge pump and motor (23, 24), the fluid filter 25, the one-way valve 26, the landing valve 28 and all of the intermediate fluid conduit 27 are included within the outer control loop 65, as are fluid conduits 14 to 16, 27 and 32 of FIG. 4, here collectively represented by conduits 61 and 62 of FIG. 6. The outer control loop also includes the hydraulic accumulator 17 which is fed with pre-charged (pressurised) fluid from the pre-charge and scavenge system. Thus, the pre-charge system serves not only to supply pressurised fluid to the fluid pump B serving the extend chamber of the actuator, but also serves to pre-charge/pressurise the fluid so supplied to the fluid accumulator 17 and assists in mass counterbalance.

Figure 1:
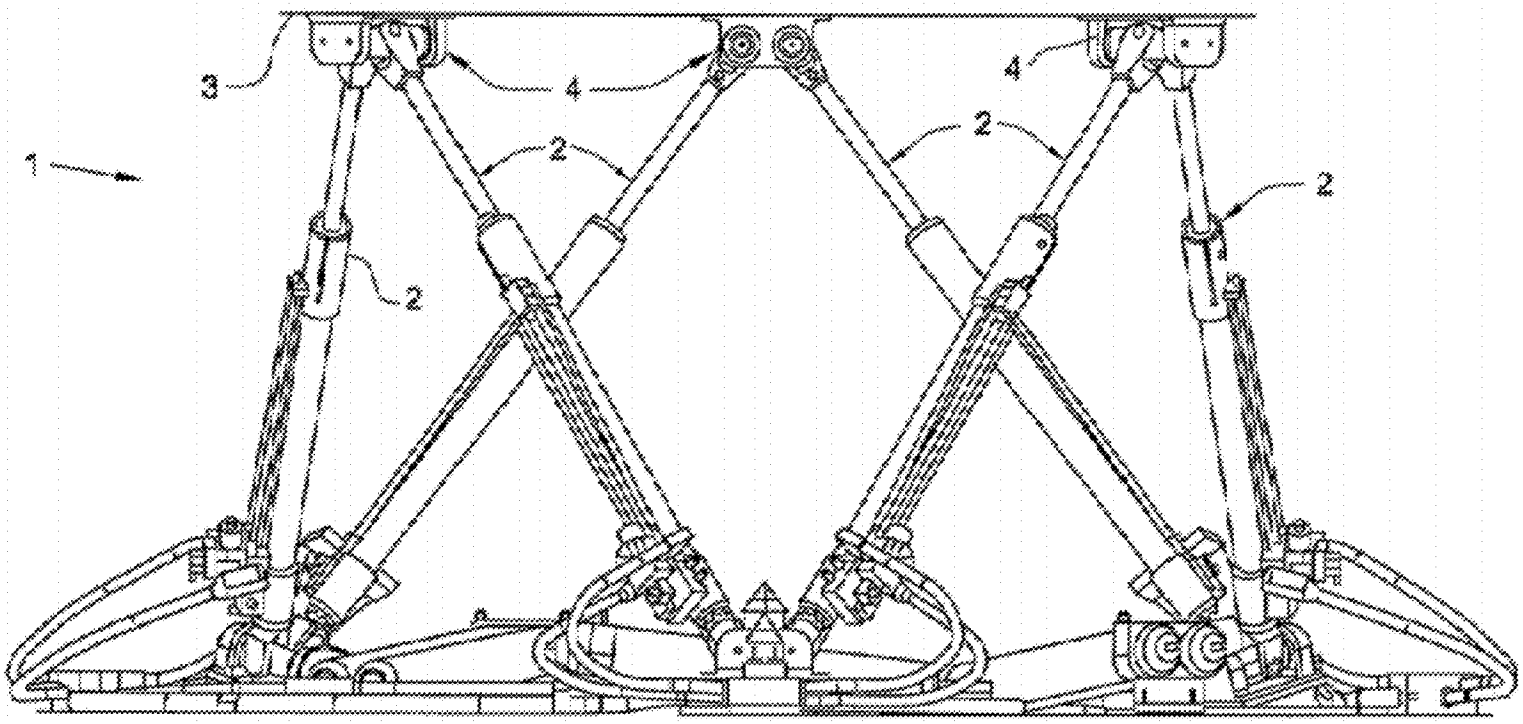
FIG.1 PRIOR ART

The accumulator 17 is therefore common to both the inner and outer control loops. In multi-actuator systems (e.g. FIG. 1) each actuator may have its own dedicated inner control loop and hydraulic accumulator (e.g. mounted upon the actuator) but be served by a pre-charge and scavenge system 22 (outer control loop) common to all (or at least two or more) actuators of the system.

The outer control loop also includes fluid pressure sensors (not shown) arranged at suitable locations within the scavenge system assembly to monitor the fluid pressure of fluid supplied thereby to the actuator. The pressurisation and transfer of fluid by the second control loop is controlled, in response to the measured values provided by the pressure sensors, to either maintain equilibrium between the actuator and its load, or to produce another desired response in the actuator.

A control apparatus (not shown) is also provided to receive the outputs of the pressure and position sensors of the inner and outer control loops and to control the pressurisation of the fluid provided by each loop, and the transfer of that fluid around the loops, as desired. Computer control means may be employed to receive and analyse the sensor signals and to generate the appropriate control signals for controlling fluid pressurisation and transfer.

Thus, the embodiment of the invention illustrated in the schematic arrangement of FIGS. 5 and 6 provides a "maintained, closed loop system" as will be readily appreciated by those skilled in the art.

The actuator (or each actuator in a multi-actuator system) has its own hydraulic accumulator, which, although forming a part of the outer control loop, is integral with the closed loop hydraulic system, as every movement of the actuator will transfer fluid to and from the accumulator. To compensate for any leakage through the hydrostatic rod bearing (19 of FIGS. 3 and 4), the accumulator is continuously fed with fluid at a pressure commensurate with the mass of the load (e.g. simulator platform) and commensurate with the induced pressure increase (or decrease) caused by changes in the actuator orientation/geometry at any given time.

This variation in supplied pressure is accomplished by the pre-charge unit 22, which is part of the outer control loop, by the opening and/or closing of fluid flow control valves to the accumulator 17 of the/each actuator and by the simultaneous suitable adjustment of the speed of the pre-charge motor 23 to alter the rate of fluid supply to the hydraulic accumulator in question. The suitable manipulation of the flow control valves of the outer control loop (e.g. valve 26) allows the independent adjustment of fluid pressure for multiple accumulators (in an multi-actuator system) using a single pre-charge fluid pump. In this way, the accumulator 17 of each actuator is part of a closed-loop hydraulic system—it maintains pressure with the system through the pre-charge pump 23 and the bearing feed 19.

A counterbalance force is inherently provided by the hydraulic accumulator of the/each actuator and a positive thrust is provided at all times at the actuator for mass counterbalance.

An external pressure loop is also provided by the outer control loop and includes fluid leakage conduit 30. Fluid leakage flow from the hydrostatic bearing 19 of the actuator is channelled to the fluid supply 21 of the pre-charge and scavenge system 22 and enters the rod-side chamber 7 via a bearing leakage. The rod bearing feed is part of the outer control loop and draws its pressurised fluid from the accumulator at counterbalance pressure. Being a hydrostatic bearing it preferably requires a constant flow, which, in the present embodiment, is employed as a useful leakage path to stabilise medium term pressure fluctuations in the retract chamber 7 of the actuator. Since pressure is applied to either side of the actuator piston 9 at the same pressure, this means that there is substantially no leakage past the piston (no pressure drop) and the counterbalance pressure is such that there is no tendency for the actuator to retract when subjected to a load. In this way, the internal leakages are controlled and limited, which contributes to overall energy efficiency.

As discussed above, the hydraulic accumulator(s) is pressurised by the pre-charge motor/pump set, and fluid pressure and actuator position/velocity are monitored constantly, while fluid pressure within the accumulator(s) is adjusted by the control means to maintain equilibrium as between the actuator and its load. There are two distinct requirements of a counterbalance system:

(1) Short term pressure variations in the supplied fluid pressure are desirable to compensate for orientation/geometry changes in the actuator as a result of motion activity (e.g. in a motion simulator platform;

(2) Medium term pressure adjustments are desirable to compensate for geometry/orientation changes in the actuator as a result of a load (e.g. simulator platform) attitude being held for extended periods (e.g. during simulated take-off and climb-out, flight refuelling, approach and landing).

These pressure variations are accommodated by the fluid pressurisation provided by the hydraulic accumulator 17 and the pre-charge motor and pump system (23, 24). In preferred arrangements, to reduce the work done by the pre-charge motor/pump arrangement, the hydraulic accumulator (for the/each actuator) is sized so that the short-term pressure increases/decreases are achieved automatically by virtue of the changes in the volume (and therefore the pressure) of the fluid stored within the hydraulic accumulator in question. Consequently, the accumulator charge volume is matched to the rod displacement so that the fluid pressure supplied thereby rises and falls according to the position/extension and geometry of the actuator, without requiring additional pressure control.

Over-pressure relief is provided for the accumulator 17 of each actuator. The fluid rate between the accumulator and the actuator is half that of a conventional hydraulic motion system, and with similar pressure fluctuations. This permits the use of smaller flexible hoses for use as fluid conduits, and reduces the fatigue load. A direct acting pressure relief valve may be employed in preferred embodiments to protect both the accumulator and the pressure hose. A low restriction, anti-cavitation system, for the fluid pump B supplied by the accumulator, is provided in the event of accumulator failure. It is this pump which is supplied with pressurised fluid for counterbalance and is vulnerable if the accumulator fails and does not have any reserve capacity to supply the pump. To counter this situation a low restriction anti-cavitation circuit is preferably included (as would be readily understood by the skilled person) for the/each accumulator supply.

It is to be understood that variants of and modifications to any one of the embodiments described above, such as would be readily apparent to the skilled person, may be made without departing from the scope of the present invention.

The invention claimed is:

1. An actuator, comprising:

an actuator chamber including a moveable actuator piston and an actuator rod connected to the actuator piston and retractably extendable from the actuator chamber;

the actuator chamber and actuator piston defining an extend chamber and a retract chamber separated from the extend chamber by the actuator piston such that the actuator rod extends through the retract chamber; and a fluid supply means arranged to supply pressurized fluid to both the extend and the retract chambers, to maintain, at all time the fluid supply means is operative, a pressure of the pressurized fluid in the extend chamber to be substantially the same as a pressure of the pressurized fluid in the retract chamber, and to reversibly transfer said pressurized fluid between the extend and the retract chambers of the actuator, the pressure of the pressurized fluid based on a difference in area between an area of the actuator piston facing into the retract chamber and an area of the actuator piston facing into the extend chamber and a load applied to the actuator in use.

2. The actuator according to claim 1, wherein the fluid supply means is operable to control the pressure of the pressurized fluid supplied thereby to the extend and retract chambers to be sufficient to enable the actuator to support the load applied to the actuator in use.

3. The actuator according to claim 1, wherein the fluid supply means is arranged to reversibly transfer said pressurized fluid between the extend and retract chambers of the actuator, and to separately and independently reversibly transfer said pressurized fluid between the extend chamber and a pressurized fluid store means.

4. The actuator according to claim 1, wherein the fluid supply means is arranged to transfer between the extend and retract chambers volumes of pressurized fluid substantially equal to a change in the volume of the retract chamber.

5. The actuator according to claim 4, wherein the fluid supply means is arranged to transfer to and from the extend chamber volumes of pressurized fluid substantially equal to the change in the volume of the extend chamber less the concurrent change in the volume of the retract chamber.

6. The actuator according to claim 1, wherein the fluid supply means includes a first fluid transfer means in fluid communication with the extend chamber and the retract chamber, the first fluid transfer means arranged to transfer there between volumes of fluid substantially equal in magnitude to changes in the volume of the retract chamber resulting from movement of the actuator piston within the actuator chamber; and a second fluid transfer means in fluid communication with the extend chamber and operable to transfer to and from the extend chamber volumes of fluid substantially equal in magnitude to the difference between said changes in the volume of the retract chamber and concurrent changes in the volume of the extend chamber.

7. The actuator according to claim 6, wherein the first fluid transfer means is a reversible first fluid pump, and the second fluid transfer means is a reversible second fluid pump whereby the second fluid pump is arranged to pump fluid at a volumetric rate determined according to the volumetric pump rate of the first fluid pump.

8. The actuator according to claim 7, wherein the actuator chamber, actuator piston and parts of the actuator rod within the actuator chamber define a volume of the retract chamber to be of substantially annular volume, whereby a ratio of the concurrent volumetric pump rates of the second and first fluid pumps is substantially equal to the ratio of: changes in the volume of the parts of the actuator rod within the retract chamber; and, corresponding changes in the annular volume of the retract chamber.

9. The actuator according to claim 8, wherein the second fluid transfer means is in fluid communication with a fluid vessel and is arranged to transfer fluid from the extend chamber to the fluid vessel and vice versa, wherein the fluid vessel is arranged to hold fluid received thereby from the second fluid transfer means in a state sufficiently pressurized to generate a back-pressure upon the second fluid transfer means which partially resists a flow of fluid from the second fluid transfer means to the fluid vessel.

10. The actuator according to claim 9, wherein the fluid vessel is a fluid conduit connecting the second fluid transfer means in fluid communication with, and terminating at, a hydraulic accumulator.

11. The actuator according to claim 10, wherein the second fluid transfer means is a reversible fluid pump and said fluid vessel is arranged to generate said back-pressure being sufficient to urge the reversible fluid pump of the second fluid transfer means to back-drive thereby to urge the reversible fluid pump to operate to pump fluid from the fluid vessel to the extend chamber.

12. The actuator according to claim 9, wherein said fluid vessel is operable to be in fluid communication with said first fluid transfer means via said second fluid transfer means.

13. The actuator according to claim 9 including a fluid supply operable to be in fluid communication with and to supply pressurized fluid to said fluid vessel.

14. A motion platform for a vehicle motion simulator machine including an actuator according to claim 1.

15. A vehicle motion simulator including a motion platform according to claim 14.

16. The actuator according to claim 1, further comprising:

a landing valve configured to return the actuator to a fully retracted state.

17. A method of actuation for use with an actuator comprising:

an actuator chamber containing a moveable actuator piston;

an actuator rod connected to the actuator piston and retractably extendable from the actuator, the actuator chamber and actuator piston defining an extend chamber; and a retract chamber separated from the extend chamber by the actuator piston such that the actuator rod extends through the retract chamber, the method including:

supplying pressurized fluid to the actuator;

maintaining, by using a fluid supply means at all time the fluid supply means is operative, a pressure of the pressurized fluid in the extend chamber to be substantially the same as a pressure of the pressurized fluid in the retract chamber, the pressure of the pressurized fluid based on a difference in area between an area of the actuator piston facing into the retract chamber and an area of the actuator piston facing into the extend chamber and a load applied to the actuator in use; and reversibly transferring said pressurized fluid between the extend and the retract chambers of the actuator.

18. The method according to claim 17, further comprising:

returning the actuator to a fully retracted state by a landing valve.

19. The method according to claim 17 including controlling the pressure of the pressurized fluid supplied to the extend and retract chambers to be sufficient to enable the actuator to support the load applied to the actuator in use.

20. The method according to claim 17 including reversibly transferring said pressurized fluid between the extend and the retract chambers of the actuator, and separately and independently reversibly transferring said pressurized fluid between the extend chamber and a pressurized fluid store means.

21. The method according to claim 17 including transferring between the extend and retract chambers volumes of pressurized fluid substantially equal to a change in the volume of the retract chamber.

22. The method according to claim 21 including transferring to and from the extend chamber volumes of pressurized fluid substantially equal to the change in the volume of the extend chamber less the concurrent change in the volume of the retract chamber.

23. The method of actuation according to claim 22 for use in providing simulated motion in a vehicle simulator machine.

24. The method according to claim 17 including transferring between the extend chamber and the retract chamber volumes of fluid substantially equal in magnitude to changes in the volume of the retract chamber resulting from movement of the actuator piston within the actuator chamber; transferring to and from the extend chamber volumes of fluid substantially equal in magnitude to the difference between said changes in the volume of the retract chamber and concurrent changes in the volume of the extend chamber.

25. The method of actuation according to claim 24, wherein fluid is transferred between the extend chamber and the retract chamber by the reversible pumping thereof at a first volumetric pump rate, and fluid is transferred to and from the retract chamber by the reversible pumping thereof at a second volumetric pump rate determined according to the first volumetric pump rate.

26. The method of actuation according to claim 25, wherein the actuator chamber, actuator piston and the parts of the actuator rod within the actuator chamber define a volume of the retract chamber of substantially annular volume, whereby the ratio of the concurrent second and first volumetric pump rates is substantially equal to the ratio of: changes in the volume of the parts of the actuator rod within the retract chamber; and, corresponding changes in the annular volume of the retract chamber.

27. The method of actuation according to claim 24 including holding fluid transferred from, or to be transferred to, the extend chamber in a state sufficiently pressurized to generate a back-pressure which partially resists the transfer of fluid from the extend chamber.

28. The method of actuation according to claim 27 including providing a reversible fluid pump arranged to perform said transfer of fluid to and from the extend chamber by pumping said pressurized fluid, and generating said back-pressure to be sufficient to urge the reversible fluid pump to back-drive thereby to urge the reversible fluid pump to operate to pump said held fluid to the extend chamber.

* * * * *